US008374375B2

(12) United States Patent
Hu

(10) Patent No.: US 8,374,375 B2
(45) Date of Patent: Feb. 12, 2013

(54) EARPHONE DEVICE WITH BI-STABLE CONCHAL WALL STABILIZER

(75) Inventor: Zhenfei Hu, Klarup (DK)

(73) Assignee: GN Netcom A/S (DK)

( * ) Notice: Subject to any disclaimer, the term of this patent is extended or adjusted under 35 U.S.C. 154(b) by 30 days.

(21) Appl. No.: 12/673,859

(22) PCT Filed: Sep. 1, 2008

(86) PCT No.: PCT/DK2008/000309

§ 371 (c)(1),
(2), (4) Date: Feb. 15, 2011

(87) PCT Pub. No.: WO2009/030229

PCT Pub. Date: Mar. 12, 2009

(65) Prior Publication Data

US 2011/0123059 A1 May 26, 2011

(30) Foreign Application Priority Data

Sep. 4, 2007 (DK) ..... 2007 01266

(51) Int. Cl.
*H04R 25/00* (2006.01)

(52) U.S. Cl. ..... 381/380; 381/328

(58) Field of Classification Search ..... 381/328, 381/370, 380–381; 379/430; 181/129–131
See application file for complete search history.

(56) References Cited

U.S. PATENT DOCUMENTS

| | | | | |
|---|---|---|---|---|
| 1,953,437 | A | 4/1934 | Schier | |
| 5,298,692 | A | 3/1994 | Ikeda et al. | |
| 6,810,987 | B1 * | 11/2004 | DeKalb | 381/380 |

FOREIGN PATENT DOCUMENTS

| | | |
|---|---|---|
| JP | 2004 128721 | 4/2004 |
| WO | WO 03/075608 | 9/2003 |
| WO | WO 2004/056152 | 7/2004 |

OTHER PUBLICATIONS

International Search Report for PCT/DK2008/000309.

* cited by examiner

*Primary Examiner* — Suhan Ni
(74) *Attorney, Agent, or Firm* — Altera Law Group, LLC

(57) ABSTRACT

An earphone device (1) comprising a main body (14) to be inserted in the outer ear (28) of a user, a conchal wall stabilizer (4) extending from the main body (14) and adapted to engage the conchal wall (24) of the ear (28), the conchal wall stabilizer (4) being able to assume different positions in relation to the main body (4). The conchal wall stabilizer (4) is a bi-stable mechanism, which is movable from a first stable position via a dead point to a second stable position. Spring means (32) biases the conchal wall stabilizer (4) towards the first stable position, when the conchal wall stabilizer (4) is positioned on a first side of the dead point, and towards the second stable position, when the conchal wall stabilizer (4) is positioned on a second side of the dead point.

10 Claims, 3 Drawing Sheets

EARPHONE DEVICE WITH BI-STABLE CONCHAL WALL STABILIZER

FIELD OF THE INVENTION

Figure 1:
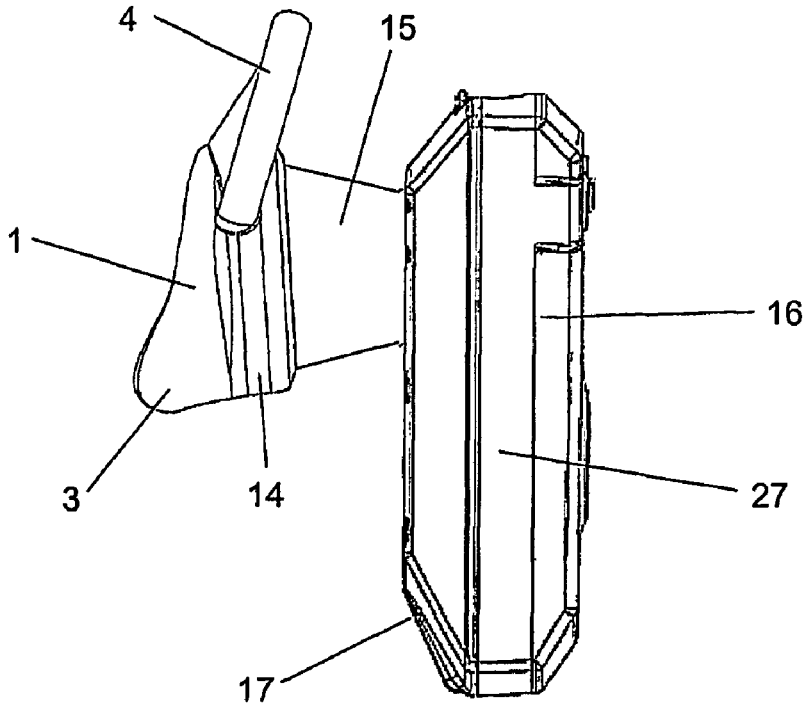

The invention relates to an earphone device comprising a main body to be inserted in the outer ear of a user, a conchal wall stabilizer extending from the main body and adapted to engage the conchal wall of the ear, the conchal wall stabilizer being able to assume different positions in relation to the main body.

THE PRIOR ART

Earphone devices like the one according to the preamble of claim 1 are typically used in connection with telecommunication or audio listening. Typical requirements to such a device are a good acoustic coupling with the ear, a secure attachment to the ear and a comfortable wearing.

The prior art discloses several attempts to provide earphone devices seeking to fulfil one or more of these requirements.

U.S. Pat. No. 5,953,435 discloses an earphone device with a conchal wall stabilizer. The distance between the earphone speaker and the conchal wall stabilizer can be adjusted by sliding the conchal wall stabilizer along a groove.

WO 2004/056152 discloses an earphone device with a conchal wall stabilizer wherein the distance between the earphone speaker and the conchal wall stabilizer can be adjusted. Furthermore, spring means forces the conchal wall stabilizer away from the earphone speaker.

U.S. Pat. No. 1,893,143 discloses an earphone device according to the preamble of claim 1. The conchal wall stabilizer is embodied as a metallic arm, which can be rotated in relation to the main body and bend such that the earphone device can be adapted to either the right or the left ear of a plurality of sizes of ears. The ability to rotate is obtained by means of a metallic ring provided with spring fingers, which encircle a collar. Friction keeps the ring and thus the arm in the desirable rotational position. Axial adjustment, which means in the direction to and from the user's head, of the outer end of the arm relative to the main body is made by bending the arm.

U.S. Pat. No. 5,712,453 A discloses an earphone device with a conchal stabilizer located on an upper surface of an ear cushion. The conchal stabilizer has a stabilizer pad located on two support ribs. The conchal stabilizer adapts to a plurality of sizes of ears by applying angular tension to a tension point between the stabilizer pad and the supporting ribs.

The object of the invention is to provide an earphone device with a simple and reliable adjustability of the conchal wall stabilizer.

THE OBJECT OF THE INVENTION

According to the invention the object is obtained by an earphone device according to the preamble claim 1, wherein the conchal wall stabilizer is a bi-stable mechanism, which is movable from a first stable position via a dead point to a second stable position, wherein spring means biases the conchal wall stabilizer towards the first stable position, when the conchal wall stabilizer is positioned on a first side of the dead point, and towards the second stable position, when the conchal wall stabilizer is positioned on a second side of the dead point. This solution provides a very simple, reliable adjustability that is easy to use. This adjustability can be utilized to different purposes, such as to adapt the device to different ear sizes, to the left or right ear, easier insertion or to provide two wearing positions with different acoustic coupling.

According to an embodiment, the spring means comprises a leaf spring with a first stable geometry corresponding to the first stable position and a second stable geometry corresponding to the second stable position. This is a very simple and reliable way of providing the bi-stable mechanism.

The leaf spring may have a first side and a second side, wherein the first side is convex when the leaf spring assumes the first stable geometry, and concave when the leaf spring assumes the second stable geometry.

According to an embodiment, the leaf spring is essentially crescent shaped with a concave edge and a convex edge, wherein the leaf spring along the concave edge is fastened to the main body.

Along the convex edge, the leaf spring may be fastened to an outer, loop-shaped part. The outer part is preferably thicker than the leaf spring. Preferably, the outer part is rounded in order to provide a more comfortable fitting against the outer wall.

According to an embodiment, the conchal wall stabilizer is movable in a direction to and from the user's head when inserted in to the ear of the user.

According to an embodiment, the main body has a first side that faces the user's head when inserted, and a second side that faces away from the user's head when inserted and a circumferential portion connecting the first side and the second side, wherein the conchal wall stabilizer is connected to the circumferential portion.

According to an embodiment, a cavity is provided in the second side, which cavity is adapted for holding an earphone speaker housing. Such an embodiment can be detached temporarily from the speaker housing for cleaning or replacement.

The main body and the conchal wall stabilizer are preferably moulded in one piece of a flexible material, such as rubber material.

According to an embodiment, the earphone device comprises a sound opening connecting the first side with the cavity, wherein the main body further comprises an ear canal protrusion to be inserted into the entrance of the ear canal.

According to an embodiment, the cross section of the ear canal protrusion is smaller than the cross section of the ear canal and the ear canal protrusion is having a first side adapted to lie against the ear canal wall and a second side lying opposite the first side and besides the sound opening. In this way, the earphone device utilizes the ear canal to support itself in the outer ear and ensures that the sound opening is located close to the ear canal and thus a good acoustic coupling. Dampening of the high frequencies can be minimized as a relatively large opening can be provided beside the ear canal protrusion. In addition, other disadvantages, such as occlusion effects or other discomfort due to sealing off the ear canal, are avoided with the solution according to the invention.

Preferably, the second side of the ear canal protrusion is bordering the periphery of the sound opening. Thereby, it is ensured that sound is directed to the ear canal.

The ear canal protrusion may extend along a part of the sound openings periphery.

According to an embodiment, the first side of the ear canal protrusion is convex seen in cross-section perpendicular to the axis of the sound opening. Hereby, a more comfortable abutment of the ear canal protrusion against the ear canal wall is obtained.

The second side of the ear canal protrusion may be concave seen in cross-section perpendicular to the axis of the sound opening. Thus, a gutter shaped or through shaped ear canal protrusion is obtained, which ensures a proper alignment of the sound opening to the ear and at the same time a relatively firm ear canal protrusion.

Preferably, the sound opening has a diameter of at least 3 mm, preferably at least 4 mm. This provides for a good acoustic coupling without filtering off the higher frequencies.

THE DRAWINGS

Figure 2:
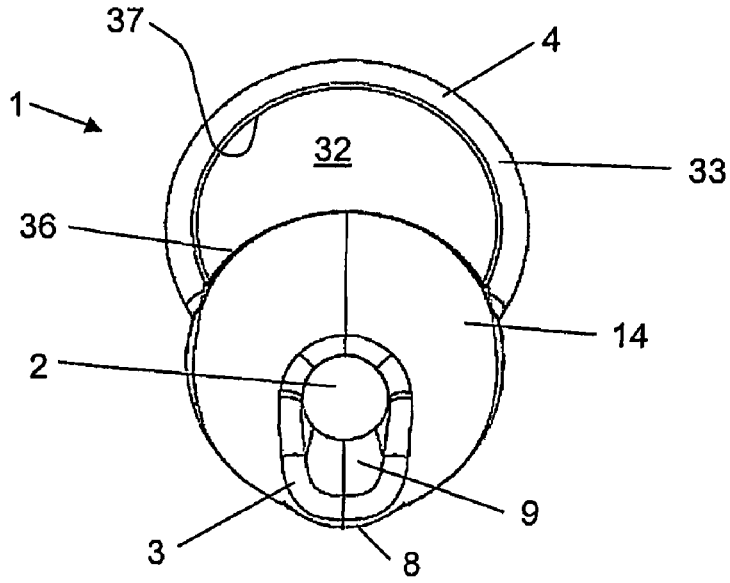
Figure 3:
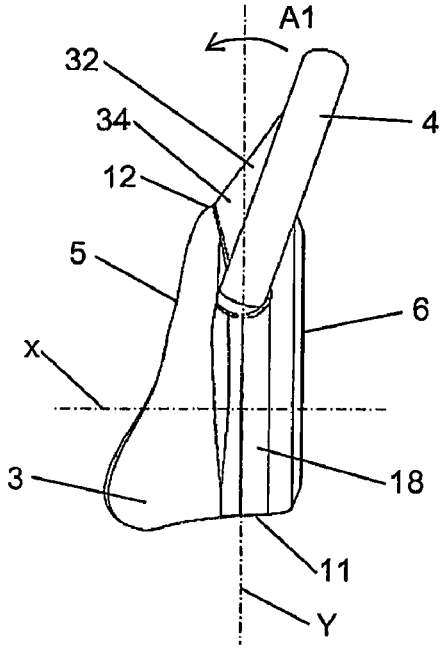
Figure 4:
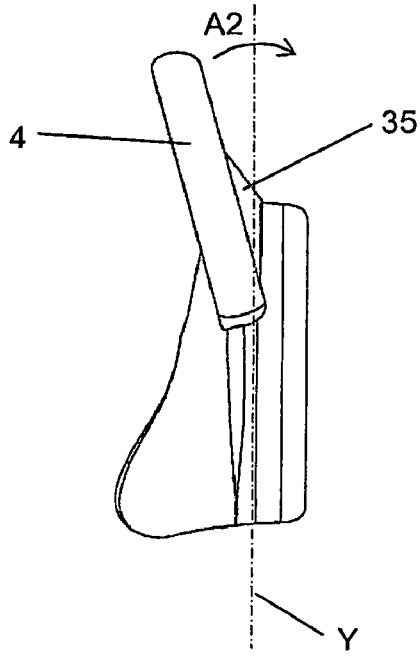
Figure 5:
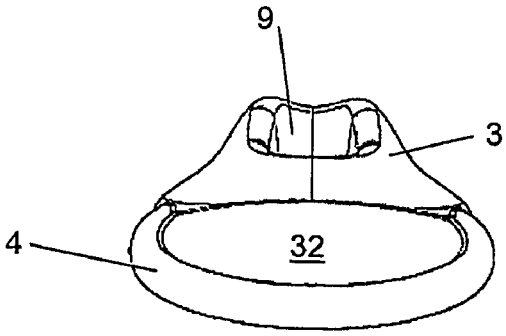
Figure 6:
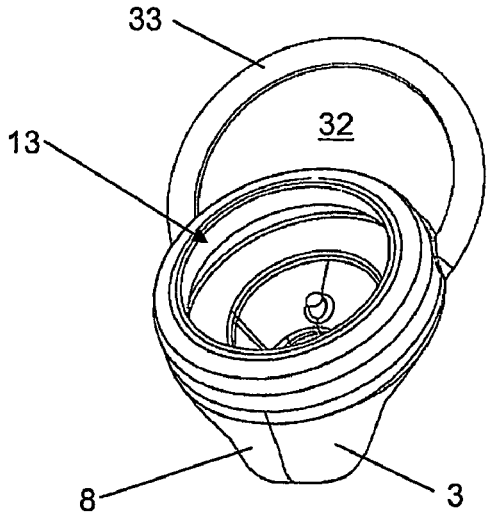
Figure 7:
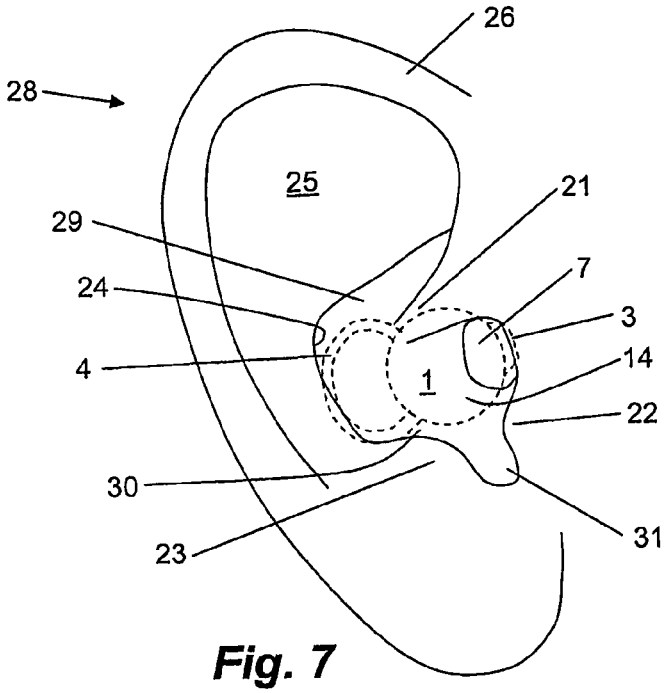
Figure 8:
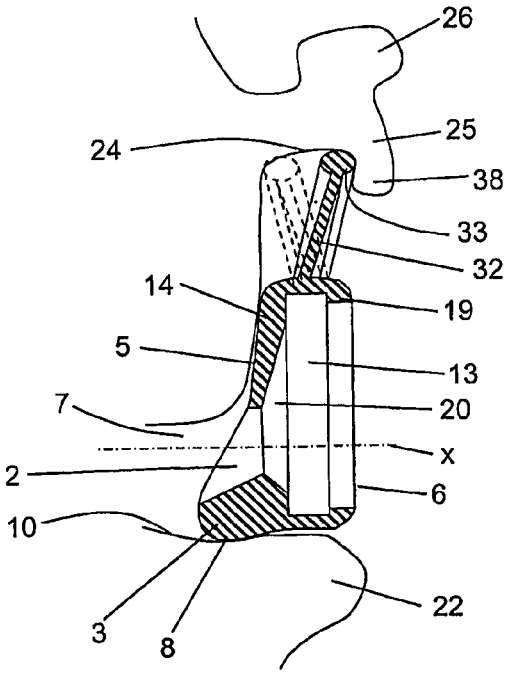
Figure 9:
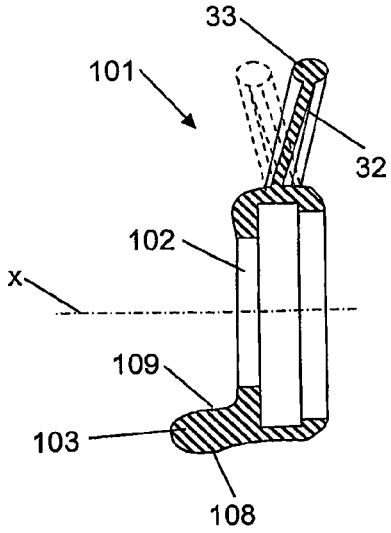

The invention is explained in detail below with reference to the drawings illustrating preferred embodiments of the invention and in which FIG. 1 shows a headset with a first embodiment of an earphone device according to the invention seen from the side, FIG. 2 shows a front view of the earphone according to the first embodiment of the invention, FIG. 3 shows a side view of the earphone device according to the first embodiment of the invention with the conchal wall stabilizer in a first position, FIG. 4 shows a side view of the earphone device according to the first embodiment of the invention with the conchal wall stabilizer in a second position, FIGS. 5-6 show the first embodiment of the earphone device seen from different angles, FIG. 7 shows a schematic side view of the ear of a user with the earphone device inserted therein, FIG. 8 shows the first embodiment of the earphone device in cross-sectional view and inserted in the ear of a user, and FIG. 9 shows a cross-sectional view through a second embodiment of an earphone device according to the invention.

The following reference signs are used in the figures and the following

DETAILED DESCRIPTION OF THE PREFERRED EMBODIMENTS

1, 101 earphone device
2, 102 sound opening
3, 103 ear canal protrusion
4 conchal wall stabilizer
5 first side of main body
6 second side of main body
7 ear canal
8, 108 outer side of ear canal protrusion
9, 109 inner side of ear canal protrusion
10 wall of ear canal
11 first end of main body
12 second end of main body
13 cavity to receive a speaker housing
14 main body
15 earphone speaker housing
16 headset
17 microphone opening
18 circumferential portion of main body
19 rim of cavity
20 funnel-shaped cavity
21 crux of helix
22 tragus
23 antitragus
24 conchal wall
25 antihelix
26 helix
27 headset housing
28 outer ear
29 upper concha
30 lower concha
31 intertragic notch
32 leaf spring
33 outer part of conchal wall stabilizer
34 first side of leaf spring
35 second side of leaf spring
36 concave edge
37 convex edge
38 outer rim of conchal wall
X axis of sound opening
Y main plane of the main body

DESCRIPTION OF AN EXEMPLARY EMBODIMENT

FIG. 1 is a perspective view of a wireless headset 16 (e.g. a Bluetooth headset) to be used for telecommunication. The headset comprises a headset housing 27 that contains a battery, a printed circuit board with transmitter/receiver electronics etc. One or more control buttons (not shown) are arranged on the outside of the housing 27 and a microphone opening 17 is arranged at one end of the housing. At the opposite end, a speaker housing 15 protrudes from the side of the housing 17. An earphone device 1 according to the invention is detachably mounted on the free end of speaker housing 15. The earphone device 1 is designed to be fastened in the outer ear of a user in a comfortable way and lead sound from speaker openings (not visible) in the free end of the speaker housing 15 to the ear canal. The earphone device 1 comprises a main body 14, an ear canal protrusion 3 and a conchal wall stabilizer 4.

FIGS. 2-6 disclose the earphone device 1 detached from the headset and from different angles. FIG. 2 is a front view, FIGS. 3 and 4 are side views, FIG. 5 is a top view, and FIG. 6 is a perspective view from behind. The main body 14 has a first side (front) 5, a second side (back) 6, a first end (lower end) 11 and a second end (upper end) 12. The second side 6 is plane and parallel with the main plane Y of the main body 14. A circumferential portion 18 connects the first side 5 and the second side 6. The ear canal protrusion 3 protrudes from the first side 5 at the first end 11 of the main body 14 and in a direction essentially perpendicular to the main plane Y of the main body 14. The conchal wall stabilizer 4 extends from the circumferential portion 18 at the second end 12. A sound opening 2 in the first side 5 of the main body 15 is located just above the ear canal protrusion 3. The sound opening 2 has an axis X that is perpendicular to the main plane Y of the main body 14. The ear canal protrusion 3 has an outer side 8 that is convex seen in cross section perpendicular to the axis X of the sound opening and parallel with the plane Y of the main body 14. The inner side 9 of the ear canal protrusion 3 that faces the sound opening 2 is concave when seen in the same cross section. FIG. 6 discloses a cavity 13 to receive the free end of the speaker housing 15. The earphone device 1 is moulded in one piece of flexible material, such as rubber.

The conchal wall stabilizer 4 is embodied as a crescent-shaped leaf spring 32 with a concave edge 36 and a convex edge 37. It is fixed along its concave edge 36 to a part of the essentially cylindrical circumferential portion 18 of the main body. The leaf spring 32 is along its convex edge 37 fixed to an outer, loop-shaped part 33. This outer part 33 extends along the entire convex edge 37 and is fixed at both its ends to the main body 14. The outer part 33 has a rounded cross section (see FIGS. 8 and 9), which ensures a comfortable abutment against the conchal wall 24 of the user's ear 28. The conchal wall stabilizer 4 is due to the dimensions of the leaf spring 32 and the outer part 33 a bi-stable mechanism that can be flexed between two stable positions. FIG. 3 shows the conchal wall stabilizer 4 in the first stable position and FIG. 4 shows the conchal wall stabilizer 4 in the second stable position. A dead point lies somewhere between the two stable positions, for example close to the main plane Y. When the conchal wall stabilizer 4 is positioned on a first side of this dead point (to the left in FIGS. 3 and 4), the leaf spring 32 urges 32 the outer part 33 to the first stable position. When the conchal wall stabilizer 4 is positioned on the opposite side of the dead point (to the right in FIGS. 3 and 4), the leaf spring 32 urges the outer part 33 to the second stable position shown in FIG. 4. By applying a momentary force, the user can push the conchal wall stabilizer 4 by the dead point and switch the conchal wall stabilizer 4 between the first and the second position. The geometry of the leaf spring 32 and the outer part 33 keeps the entire conchal wall stabilizer 4 in either the first or the second position.

In the embodiment shown here the purpose of the bi-stable conchal wall stabilizer 4 is to facilitate insertion and removal of the earphone device 2 to/from the outer ear 28. This will appear from the following description.

For illustration purposes and to aid in the understanding of the placement of the earphone device of the present invention, a typical human ear is illustrated in FIG. 7. The outer ear or pinna 28 is an irregularly concave cartilaginous member comprised of a number of eminences and depressions, which give each ear a distinct shape and form. The helix 26 is the curved outer rim of the ear. Below the helix 26 is the antihelix 25. The antihelix 25 is a curved prominence, which describes a curve around the concha, a deep cavity containing the entry to the ear canal 7. The concha is divided into two parts, the upper concha 29 and the lower concha 30, by the crux of the helix 21, which curves around the outside of the ear, and extends inwards at about the vertical midpoint of the ear. The upper concha 29 lies above the crux of the helix 21 and below the antihelix 25. The lower concha 30 lies below the crux of the helix 21 and surrounds the entry to the ear canal 7. A conchal wall 24 separates the concha from the antihelix 25. In front of the lower concha 30 and projecting backwards from the front of the ear is the tragus 22, a small semicircular prominence. Opposite the tragus 22 and separated from it by the deep curvature of the intertragic notch 31 is the antitragus 23. The intertragic notch 31 is formed between the tragus 22 and the antitragus 23.

Furthermore, FIG. 7 discloses schematically with dashed lines how the earphone device 1 is positioned in the ear 28 during use. The ear canal protrusion 3 is inserted into the ear canal 7 where it abuts the forward wall 10 (see FIG. 8) of the ear canal 7. The conchal wall stabilizer 4, which is in the first position shown in FIG. 3, abuts the conchal wall 24. The outer side 8 of ear canal protrusion 3 abuts the forward wall (10 in FIG. 8) of the ear canal 7. This secures the earphone device 1 in the ear and thereby the headset outside ear even when the user moves or accelerates his head in different directions. Thus, no external support such as an ear hook or a headband is necessary.

FIG. 8 discloses the earphone device 1 in cross section, while it is mounted in the ear of a user. The headset is removed for clarity reasons. It is clear, that the outer side 8 of the ear canal protrusion 3 abuts the forward wall 10 of the ear canal 7 and that the conchal wall stabilizer 4 abuts the conchal wall 24. Before insertion, the user ensures that the conchal wall stabilizer 4 is in the second position showed with dashed lines. This position facilitates insertion of the earphone device 1 as the conchal wall stabilizer 4 without hindrance can pass by the outer rim 38 of the conchal wall 24. After insertion, the user pushes the headset in a direction against the head, so that the first side 5 of the main body 14 locally deforms the bottom of the concha, which causes an outgoing (to the right in FIG. 8) force on outer part 33 of the conchal wall stabilizer 4. This causes a movement of the conchal wall stabilizer 4 from the second position to the first position of the wall stabilizer 4. As it can be seen in FIG. 8, the outer part 33 of the conchal wall stabilizer 4 abuts the conchal wall 24 and the inner side of the outer rim 38 of the conchal wall 24. In this situation, the earphone device 1 is held secure in the concha of outer ear 28 without exerting essential force on the conchal wall. This form-locking mounting makes the earphone device 1 comfortable to wear for the user. A compressing force against the conchal wall 24 will only be present if the user tries to pull out the earphone before he pushes the conchal wall stabilizer 4 to the second position with his finger.

The cavity 13 for receiving the speaker housing 15 of the headset 16 is open to the second side 6 of the main body 14. The cavity 13 is circular and the opening in the second side 6 is encircled by a rim 19. When the earphone device 1 is mounted on the speaker housing 15 the rim 19 grips behind a corresponding rim on the outside of the free end of the speaker housing 15. In this way, the earphone device 1 and the headset 16 remains coupled. A certain force must be exceeded to pull the earphone device 1 of the speaker housing 15. Sound from the openings in the end face of the speaker housing 15 is led through a funnel-shaped cavity 20 to the sound opening 2, which is positioned in front of the ear canal 7.

It can be seen in FIG. 8 and FIGS. 2 and 5 that the main part of the ear canal protrusion 3 is positioned below the sound opening 2. However, as the ear canal protrusion 3 has a large upper area sloping against the first side 5 of the main body 14 the sound opening 2 and the protrusion 3 provides a chute- or through-like shape. This is opposite to the prior art that discloses a sound opening arranged in the tip of the ear canal protrusion. The ear canal protrusion 3 has in FIG. 2 a convex outer side (under side) 8 and a concave inner side (upper side) 9 when seen in the plane of the paper. The axis X of the sound opening 2 is perpendicular to this plane. As shown in FIG. 8, the ear canal protrusion 3 only abuts the forward facing part of the ear canal wall 8. Thus, the ear canal protrusion 3 does not seal the ear canal 7, and discomfort due to occlusion is avoided. The sound does not have to travel through a long narrow bore or tube between the loudspeaker housing 15 and the ear canal 7 and high-frequency filtering is hereby avoided. With other words, an open a clear sound is obtained due to the relatively large sound opening, the diameter of which is preferably at least 3 or 4 mm at the transition area between the sound opening 2 and the funnel-shaped cavity 20. This is the narrowest area of the sound opening 2.

The maximum depth of the earphone device measured in the direction of the axis X of the sound opening 2 is the distance between the tip of the ear canal protrusion 3 and the second side (back side) 6 of the main body 14 and is approximately 10 mm. The maximum depth of the sound opening is the distance between the tip of the ear canal protrusion 3 and the funnel-shaped cavity 20 and is approximately 5 mm. The minimum depth of the sound opening 2 is measured at the point closest to the intra-concha stabilizer 4 and is approx. 1 mm. The depth of the funnel-shaped cavity is approximately 1 mm. The depth of the speaker house receiving cavity 13 is approximately 3 mm and the depth of the rim 19 is approximately 1 mm. The outer diameter of the circular main body 14 is approximately 16 mm. The maximum dimension of the earphone device 1 measured perpendicular to the axis X of the sound opening 2 is approximately 25 mm. In order to provide earphone devices 1 to ears of different sizes the size of the conchal wall stabilizer 4 and the ear canal protrusion 3 can be varied. Thus, a headset can be provided with three different earphone devices with identical main bodies 14 Nit different sized ear canal protrusions 3 and conchal wall stabilizers 4.

FIG. 9 discloses a second embodiment of the earphone device 101 according to the invention. The second embodiment differs from the first embodiment by the shape of the ear canal protrusion 103 and the size of the sound opening 102. The ear canal protrusion 103 is smaller than the ear canal protrusion of the first embodiment. This leaves space for a sound opening 102 with a much larger diameter.

The invention is not limited to the disclosed embodiments. The disclosed embodiments are devices adapted to be mounted on the speaker housing of a headset. However, the earphone device according to the invention could also be a headset or a hearing aid comprising speaker, electronics etc.

Throughout the application, the term "leaf spring" should be construed as a thin leaf-like piece of material, which has spring properties. In this case, the leaf spring is the crescent shaped piece of rubber material between the main body 14 and the outer part 33 of the conchal wall stabilizer 4, and which, like the shadow of a baseball cap, can be flipped between two stable positions.

The earphone device described above is symmetric which means that it fits equally well in the left and the right ear.

In the disclosed embodiments, the bi-stable mechanism is utilized to facilitate insertion into and extraction from the ear. However, the bi-stable mechanism could also be utilized to provide two wearing positions with different acoustic coupling. Thus, when not communicating through the headset or listening to music or speak through the earphone, the user could wear the earphone device in the ear with the conchal wall stabilizer in the second position. In this position the main body is not positioned so far into the ear as when the conchal wall stabilizer 4 is in the first position, whereby the ear canal can easier pick up sounds from the surroundings. If the user wants to place or receive a phone call, he pushes the earphone device shortly against the head, whereby the conchal wall stabilizer 4 moves from the second to the first position. Off course, such an embodiment requires, that the conchal wall stabilizer is dimensioned, such that the earphone device does not fall out of the outer ear, when the conchal wall stabilizer is in the second position.

The invention claimed is:

1. An earphone device comprising a main body to be inserted in the outer ear of a user, a conchal wall stabilizer extending from the main body and adapted to engage the conchal wall of the ear, the conchal wall stabilizer being able to assume different positions in relation to the main body, characterised in that the conchal wall stabilizer is a bi-stable mechanism, which is movable from a first stable position via a dead point to a second stable position, wherein a bias element biases the conchal wall stabilizer towards the first stable position, when the conchal wall stabilizer is positioned on a first side of the dead point, and towards the second stable position, when the conchal wall stabilizer is positioned on a second side of the dead point and wherein the bias element comprises a spring with a first stable geometry corresponding to the first stable position and a second stable geometry corresponding to the second stable position.

2. An earphone device according to claim 1, wherein the bias element comprises a leaf.

3. An earphone device according to claim 2, wherein the leaf spring has a first side and a second side, wherein the first side is convex when the leaf spring assumes the first stable geometry, and concave when the leaf spring assumes the second stable geometry.

4. Earphone device according to claim 3, wherein the leaf spring is substantially crescent shaped with a concave edge and a convex edge, wherein the leaf spring along the concave edge is fastened to the main body.

5. Earphone device according to claim 4, wherein the leaf spring includes a convex edge and along the convex edge is fastened to an outer, loop-shaped part.

6. Earphone device according to claim 5, wherein the outer part is thicker than the leaf spring.

7. An earphone device according to claim 1, wherein the conchal wall stabilizer is movable in a direction to and from the user's head when inserted in to the ear of the user.

8. An earphone device according to claim 7, wherein the main body has first side that faces the user's head when inserted, and a second side that faces away from the user's head when inserted and a circumferential portion connecting the first side and the second side, wherein the conchal wall stabilizer is connected to the circumferential portion.

9. An earphone device according to claim 8, wherein a cavity is provided in the second side, which cavity is adapted for holding an earphone speaker housing.

10. An earphone device according to claim 1, wherein the main body and the conchal wall stabilizer are moulded in one piece of a flexible material.

* * * * *